US007427172B2

(12) United States Patent
Lukasik

(10) Patent No.: US 7,427,172 B2
(45) Date of Patent: Sep. 23, 2008

(54) TEMPORARY ROADWAY ELEMENT

(75) Inventor: Mark Lukasik, Edmonton (CA)

(73) Assignee: Champagne Editions, Inc., Legal, Alberta (CA)

( * ) Notice: Subject to any disclaimer, the term of this patent is extended or adjusted under 35 U.S.C. 154(b) by 0 days.

(21) Appl. No.: 11/896,784

(22) Filed: Sep. 6, 2007

(65) Prior Publication Data

US 2008/0085154 A1 Apr. 10, 2008

Related U.S. Application Data

(63) Continuation-in-part of application No. 11/393,802, filed on Mar. 31, 2006.

(51) Int. Cl.

| | |
|---|---|
| ***E01C 5/22*** | (2006.01) |
| ***E01C 5/18*** | (2006.01) |
| ***E01C 5/00*** | (2006.01) |
| ***E01C 5/14*** | (2006.01) |

(52) U.S. Cl. ..... 404/36; 404/17; 404/18; 404/32; 404/34; 404/35; 404/44; 404/45; 404/46; 428/98

(58) Field of Classification Search ..... 404/29–36, 404/45, 46; 428/98

See application file for complete search history.

(56) References Cited

U.S. PATENT DOCUMENTS

| | | | | |
|---|---|---|---|---|
| 2,336,235 | A * | 12/1943 | Fischer | 404/32 |
| 2,875,101 | A * | 2/1959 | Ehrlich | 428/496 |
| 4,408,365 | A | 10/1983 | Palmer | |
| 4,465,720 | A | 8/1984 | Bell et al. | |
| 4,600,337 | A | 7/1986 | Sarver | |
| 4,850,738 | A | 7/1989 | Niemi | |
| 5,139,845 | A * | 8/1992 | Beckerman et al. | 428/117 |
| 5,273,373 | A * | 12/1993 | Pouyer | 404/35 |
| 5,275,502 | A * | 1/1994 | Glaza et al. | 404/35 |
| 5,366,224 | A * | 11/1994 | Stanwyck et al. | 473/162 |
| 6,048,129 | A | 4/2000 | Rue | |
| 6,874,972 | B2 | 4/2005 | Davis et al. | |
| 6,921,229 | B2 | 7/2005 | Klyne | |

FOREIGN PATENT DOCUMENTS

| | | |
|---|---|---|
| CA | 2473000 | 12/2005 |

* cited by examiner

*Primary Examiner*—Raymond W Addie
(74) *Attorney, Agent, or Firm*—Terry M Gernstein

(57) ABSTRACT

A plurality of wood planks are embedded and encased in a one-piece rubber mat to form a monolithic one-piece roadway element. A special coupling means is used to couple one roadway element to an adjacent roadway element to form a roadway surface over which heavy equipment can traverse.

13 Claims, 7 Drawing Sheets

TEMPORARY ROADWAY ELEMENT

CROSS REFERENCE TO RELATED APPLICATIONS

This application is a continuation-in-part application of Ser. No. 11/393,802 filed on Mar. 31, 2006 and presently pending. The disclosure of this parent application is incorporated hereinto by reference.

TECHNICAL FIELD OF THE INVENTION

The present invention relates to the general art of roads and roadways, and to the particular field of load-supporting surfaces used as a temporary road or temporary road bed.

BACKGROUND OF THE INVENTION

As discussed in the parent application, many work sites, such as construction sites, mining sites, farming, logging, gas and oil drilling sites, as well as others, often occur in areas where there is no prepared road bed. It is customary in the oilfield industry to have the requirement of transporting heavy machinery on trucks to remote areas in fields and the like where there is no prepared roadbed. Such areas may be on soft ground, mud, swam, wetlands, tundra, muskeg, sand, or the like. Often these roads are located in areas that are subject to extreme temperature ranges and must be left unattended for great lengths of time. Accordingly, these roads are subject to extreme conditions.

The axle loading of a typical heavy equipment truck is such that it is not feasible to drive it across a scraped or unprepared ground surface without experiencing sinking, jamming of the truck, and similar impediments. Accordingly, heavy equipment used at the work site requires a suitable road bed that is stable to prevent the equipment from becoming stuck in the soft ground. These vehicle also require a road that is fairly smooth. However, the nature of the industries causes the roads to traverse extremely rugged and uneven terrain. Accordingly, there are at least two competing interests in these roads: requirements for a stable and smooth surface, which must be considered against the constraints associated with uneven and unstable terrain. Exacerbating the problem is the fact that many of the roads, once constructed, will remain unattended and unrepaired for great lengths of time. Heretofore known roads have been deficient in balancing these competing objectives and the constraints placed on the roads.

Furthermore, there are frequently regulations associated with performing work in environmentally sensitive areas, which require the site to be returned to its original pristine condition when work is completed. Such site restoration can become quite expensive and labor intensive. Accordingly, while the art has been concerned with ground surfaces incapable of supporting the weight of a motor vehicle, there is now a further need to protect environmentally sensitive areas in order to reduce environmental damage.

A common practice for many years has been to construct a temporary road bed from wood planks that are laid on the ground and nailed together. Typically, a second and third layer of wood planks are laid on top of the base layer in alternating directions and secured together by nails. The number of layers of wood planks can vary depending on the stability of the ground and the weight of the equipment that will travel over the road as well as the environmental conditions surrounding the road. Various methods have been proposed to form a temporary road bed using preassembled mats constructed from wood boards. These mats typically include a structure for interlocking with an adjacent mat. These preconstructed mats are generally intended to be reusable by disassembling the road bed and transporting the mats to a new location.

Construction of a temporary road bed using individual boards is costly and labor intensive. The heavy equipment that travels over the road bed often damages a large number of the boards so that the boards cannot be reused. Disassembly of the road bed is also labor intensive and damages many of the boards not previously damaged during use. As a result, a significant portion of the boards used to construct the road bed are discarded. Still further, roads formed of wood are subject to degrading, separation and the like. If nails are used to connect boards, these nails can become dislodged and may damage the tires of vehicles traversing the road. If the nails become dislodged, the boards can become separated which can damage the tires of vehicles traversing the road or even producing slick spots. Still further, if the wood becomes damaged or nails fall out, elements of the road may remain after the road is removed thereby causing undesirable environmental damage. If the boards become separated, vehicles may cause damage to the ground in the open areas, again causing undesired environmental damage.

Therefore, temporary roadways formed entirely of wood planks as taught in the prior art have many undesirable characteristics.

Numerous examples of preconstructed mats for use in constructing a temporary road bed or flooring system are known. However, the prior methods of constructing a temporary road bed are generally expensive and time consuming. Although the preconstructed mats can reduce the time for constructing a temporary road, the cost of manufacturing the mats and the difficulty of moving and assembling the mats have limited their use.

In view of the deficiencies of the prior methods and devices, a continuing need exists in the industry for an improved method and device for constructing a temporary road bed.

This need has been approached by several methods. For example, the inventor is aware of several methods and devices for forming a temporary road bed from elements other than wood, such as rubber from discarded tires. However, the heretofore proposed methods of forming construction mats from discarded tires required the components parts of the individual tires to be separated from the tire, that is, the separation of the tire tread section from the tire sidewall section. These methods also required the individual tire segments so separated to be fixed or arrayed in a uniform or consistent manner before being linked together to form a mat. These steps in the prior methods are expensive and time consuming. Other known methods are also time consuming and labor intensive.

Still further, these known methods do not produce a mat that is stable and which has a good memory so it will return to its initial condition after supporting a very heavy load, even a load as high as thousands of tons which is common in the construction and oil drilling industry and even if the road is located in an area that is subject to extreme environmental conditions and which may be left unattended for great lengths of time. Heretofore known mats are quite likely to become damaged and permanently distorted by such heavy loads and conditions. A damaged or distorted mat must be replaced, which can add expense to the overall job through the cost of materials as well as the cost of labor, which is doubled because the damaged or distorted mat must be removed and then replaced. An unreplaced damaged road may create a hazard to vehicles and to the environment.

Consequently, a need exists for improved pavement mat as well as for improved methods in making the mat that will allow the formation of mats from discarded tires in less expensive and time consuming manner and that allows for the use of discarded tires as a mat component without requiring the separation of the component parts of the tire during the mat assembly process.

There is a further need for an improved mat which will be very stable and not likely to become permanently distorted by a heavy load, and will not tend to deteriorate or dissociate under such heavy loads and under harsh environmental and terrain situations even if left unattended for extremely long periods of time.

The temporary roadway element disclosed in the parent application overcame the above-mentioned problems and proved to be very successful in achieving the above-discussed objectives and ends. However, even with such an improvement, there is a continuing need to still further improve temporary roadway elements such as the one disclosed in the parent application.

The inventor is also aware of a rubber access mat disclosed in Canadian Patent 2,473,000 which is a rubber slab having a grid of steel wires embedded therein. The grid of steel wires includes wires extending longitudinally of the mat and wires extending transversely of the mat to define an orthogonal pattern in the rubber. This access mat is disclosed as being useful for forming a roadway or pathway for vehicles and people. While working in some conditions, the mat disclosed in this Canadian Patent has several drawbacks, for example, inter alia: the wire grid inside the rubber tends to cut the rubber when heavy loads are applied; the thermal properties of the steel wires are disadvantageous, especially in the extreme conditions in which the mats are to be used; the steel wires tend to move with respect to each other and with respect to the mat thereby creating delamination problems and defining voids within the rubber; the steel wires are often flexible and do not have a good shape memory so that once flexed, the mat may not return to its original shape which had been designed for maximum effectiveness thereby creating problems for the overall mat with regard to the terrain and with regard to load support features as well as exacerbating the just-mentioned problems; the steel of the grid does not have thermal properties that are advantageous to the rubber mat; and the orthogonal arrangement of the steel wires in the mat disclosed in the Canadian patent is not the most efficient arrangement for supporting heavy loads under the environmental conditions in which the mat is used. Furthermore, the preferred form of the mat disclosed in the Canadian patent includes two layers of grids which may tend to exacerbate the problems associated with delamination and void formation, the problems associated with rubber cutting, and problems associated with varying thermal properties. As an example of the problems associated with the mat disclosed in the Canadian patent, it is observed that movement of the steel wires in the mat may create voids in the mat which, themselves, will create problems. For example, if the wires move either due to the application of a load to the mat or due to thermal conditions or due to uneven terrain, they will tend to cut the mat and form voids which will weaken the mat and may make the mat susceptible to moisture invasion into the mat which will weaken the mat and may increase the size of the voids upon freezing. A weakened mat may tend to damage the terrain under heavy loading. Furthermore, a weakened mat may tend to break thereby vitiating the purpose of the mat.

OBJECTIVES OF THE INVENTION

It is a main objective of the present invention to improve the roadway element disclosed in the parent application.

It is another objective of the present invention to provide a roadway element that is stable, secure and long lasting.

It is another objective of the present invention to provide a roadway element that can be efficiently manufactured.

It is another objective of the present invention to provide a roadway element that if flexible to properly conform to any supporting surface on which it is placed, even if extremely heavy traffic will traverse the element and the roadway element is positioned on very uneven terrain.

It is another objective of the present invention to provide a roadway element that is extremely durable.

It is another objective of the present invention to provide a roadway element that is easy to clean.

It is another objective of the present invention to provide a roadway element that provides excellent traction to vehicular traffic using the element.

It is another objective of the present invention to provide a roadway element that has excellent shape memory, even if traversed by extremely heavy traffic.

It is another objective of the present invention to provide a roadway element that is stable even in extreme temperature conditions.

It is another objective of the present invention to provide a roadway element that is environmentally friendly.

It is another objective of the present invention to provide a roadway element that has a good shape memory.

It is another objective of the present invention to provide a roadway element that is not likely to delaminate during use.

It is another objective of the present invention to provide a roadway element that includes a skeletal structure having good insulating properties.

It is another objective of the present invention to provide a roadway element that includes a skeletal structure having a very strong shape.

It is another objective of the present invention to provide a roadway element that is not likely to have voids during use.

It is another objective of the present invention to provide a roadway element that includes a skeletal structure that is not likely to move with respect to itself or with respect to the rubber during use.

SUMMARY OF THE INVENTION

The above-discussed disadvantages of the prior art are overcome by a temporary roadway element that has a plurality of wood planks encased in a one-piece rubber mat such that the temporary roadway element is one-piece. The rubber mat is formed of crumb rubber such as crumb rubber from motor vehicle tires that is bound together using polyurethane binder, and the wood planks can be selected from green mill rough cut wood. A special coupling means is used to couple one roadway element to an adjacent roadway element to form a roadway surface over which heavy equipment can traverse.

The wood planks provide stability to the element, yet are protected by the one-pieced mat whereby the desirable properties of the wood planks are preserved. However, the overall element can be manufactured, used, stored and maintained in an efficient and cost-effective manner.

Using the element embodying the principles of the present invention will permit efficient placement of temporary roadways, temporary road coverings and the like which will be stable and long-lasting even under heavy loading and soft, pliable ground conditions and extreme weather conditions. A roadway formed of the temporary roadway element of the present invention will be secure and will not require a great deal of maintenance and will still provide secure traction to vehicles yet will be easy to place and remove with little, or no, disturbance to the environment.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
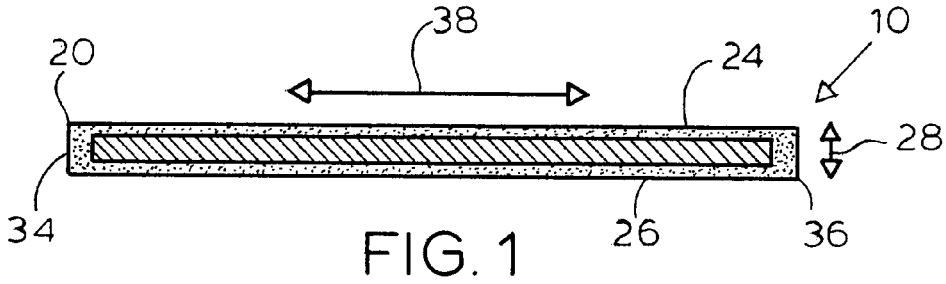
FIG. 1 is an elevational view through a longitudinal section of a temporary roadway element embodying the principles of the present invention.
Figure 2:
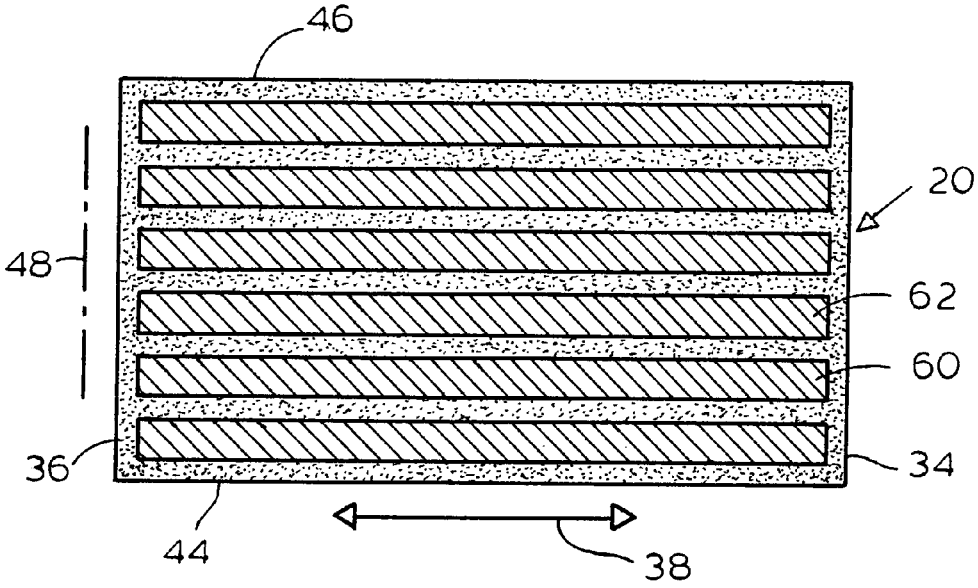
FIG. 2 is a top plan view through a section of a temporary roadway element embodying the principles of the present invention showing the wood planks which are embedded in a mat.
Figure 3:
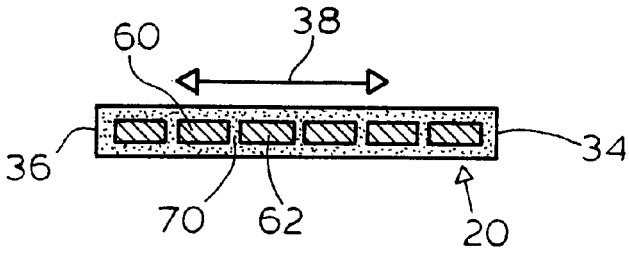
FIG. 3 is an elevational view through a transverse section of a temporary roadway element embodying the principles of the present invention showing the wood planks.

Referring to the figures, it can be understood that the principles of the present invention are embodied in a temporary roadway element 10 that is used to define a driving surface for heavy equipment, such as used in the oil drilling industry, in areas such as the Yukon swamps and the arctic tundra, or the like where environmental conditions are extremely harsh, terrain is difficult and extremely uneven, and where it is difficult to reach for road repairs, whereby the element can sustain the abusive loads needed for the transport of large heavy equipment and allows for the protection of both the native soil and the displacement of the surface of the surrounding environment. It is noted that while element 10 is disclosed for use as a temporary roadway element for use in difficult environmental conditions and to support heavy equipment, those skilled in the art will understand that this disclosure is for convenience and that a roadway element embodying the principles of the present invention can be used in other applications situations that will occur to such a skilled artisan based on the teaching of the present disclosure. Such additional applications and situations are intended to be within the scope of the present disclosure and the claims associated therewith.

Temporary roadway element 10 comprises a one-piece mat 20 formed of crumb rubber from automobile tires which has been bonded using polyurethane binder. Mat 20 includes a first surface 24 that is a top surface when the mat is in use, a second surface 26 that is a bottom when the mat is in use and a thickness dimension 28 that extends between the first surface and the second surface. In the form shown, thickness dimension 28 is five inches, but can be any thickness found necessary for the particular application of element 10. Mat 20 further includes a third surface 34 that is a first end edge when the mat is in use, a fourth surface 36 that is second end edge when the mat is in use and a longitudinal dimension 38 that extends between the first end edge and the second end edge. In the form shown, longitudinal dimension 38 is fourteen feet.

Mat 20 further includes a fifth surface 44 that is a first side edge when the mat is in use, a sixth surface 46 that is a second side edge when the mat is in use and a transverse dimension 48 which extends between the first side edge and the second side edge. In the form show, transverse dimension 49 is eight feet.

A plurality of wood planks, such as wood planks 60 and 62, are embedded in and encased by mat 20 between the first surface and the second surface and between the first and second end edges and between the first and second side edges. The wood planks extend in the direction of longitudinal dimension 38 of the mat and are spaced apart from each other in the direction of transverse dimension 48. In the form shown, the spacing between adjacent wood planks is four inches to allow the formation of a hard rubber beam, such as beam 70, between adjacent planks. Furthermore, the form shown has the wood planks formed of green mill run rough cuts wood, with the planks being sized 3"×12"× just less than 14 ft so the wood planks are sized to be encased in the mat yet will provide sufficient strength and flexibility for the purposes of the element. Moist wood increases the strength, rigidity and the flexibility memory of the roadway element. The wood planks are located inside and are encased by the one-piece rubber mat and are thus shielded by the high density crumb. Moist wood increases the strength, rigidity and the flexibility memory of the overall structure. By encasing the boards and having them embedded in the one-piece mat, the mat forms a protective shield around the wood planks thereby ensuring that they will retain the amount of moisture required to maintain the element stable and secure and able to carry out the above-discussed objectives, results and operations.

The wood planks embedded in and encased by the one-piece mat forms a one-piece monolithic structure that will be able to accommodate extremely uneven terrain in extremely harsh environmental situations while remaining stable and secure while supporting extremely heavy loads, yet will be efficient and cost-effective to manufacture, store, transport, set up, maintain and remove. The wood planks will be spaced apart from each other and thus will define an I-beam type structure that is extremely stable and strong. Still further, the wood planks will not be as subject to thermally-induced problems in the rubber as steel might be and will actually act as an insulator for the rubber thereby further vitiating the ill-effects of thermal conditions. The wood planks are large with respect to the mat and thus are not likely to move with respect to the mat or with respect to each other during use of the mat and thus the mat embodying the principles of the present invention is not likely to have voids formed therein during use and the pressure applied to the skeletal structure formed by the wood planks by loading on the mat will be much less than the pressure applied to small cross-section wire grids with the attendant advantages vis a vis the small cross-section wires.

Element 10 is easy to manufacture and thus will be easy, efficient and economical to install, repair, and remove. Element 10 is manufactured according a process that includes the steps of forming a molded slab by providing crumb rubber from recycled tires, adding fiber mix to the crumb rubber, and binding the fiber mix and the rubber using polyurethane binders; and reinforcing the molded slab by setting wood planks in the slab; and encasing the wood planks in the molded slab. More specifically, the element is formed by mixing rubber crumb with fiber and a liquid moisture curing binder, such as polyurea/polyurethane polymers of very high molecular weight until the combination is thoroughly mixed. This mixture is then poured into a mold and the wood planks are set into the mixture. The combination is then subjected to very high pressure, such as two thousand pounds or more for a predetermined length of time, such as twenty-five minutes, until fully formed. The element is then removed from the mold as element 10.

Adjacent roadway elements are coupled together to form an overall roadway. The means for connecting adjacent mat/roadway elements together to form an overall roadway embodying the principles of the present invention is indicated in FIGS. 4-9.

Figure 4:
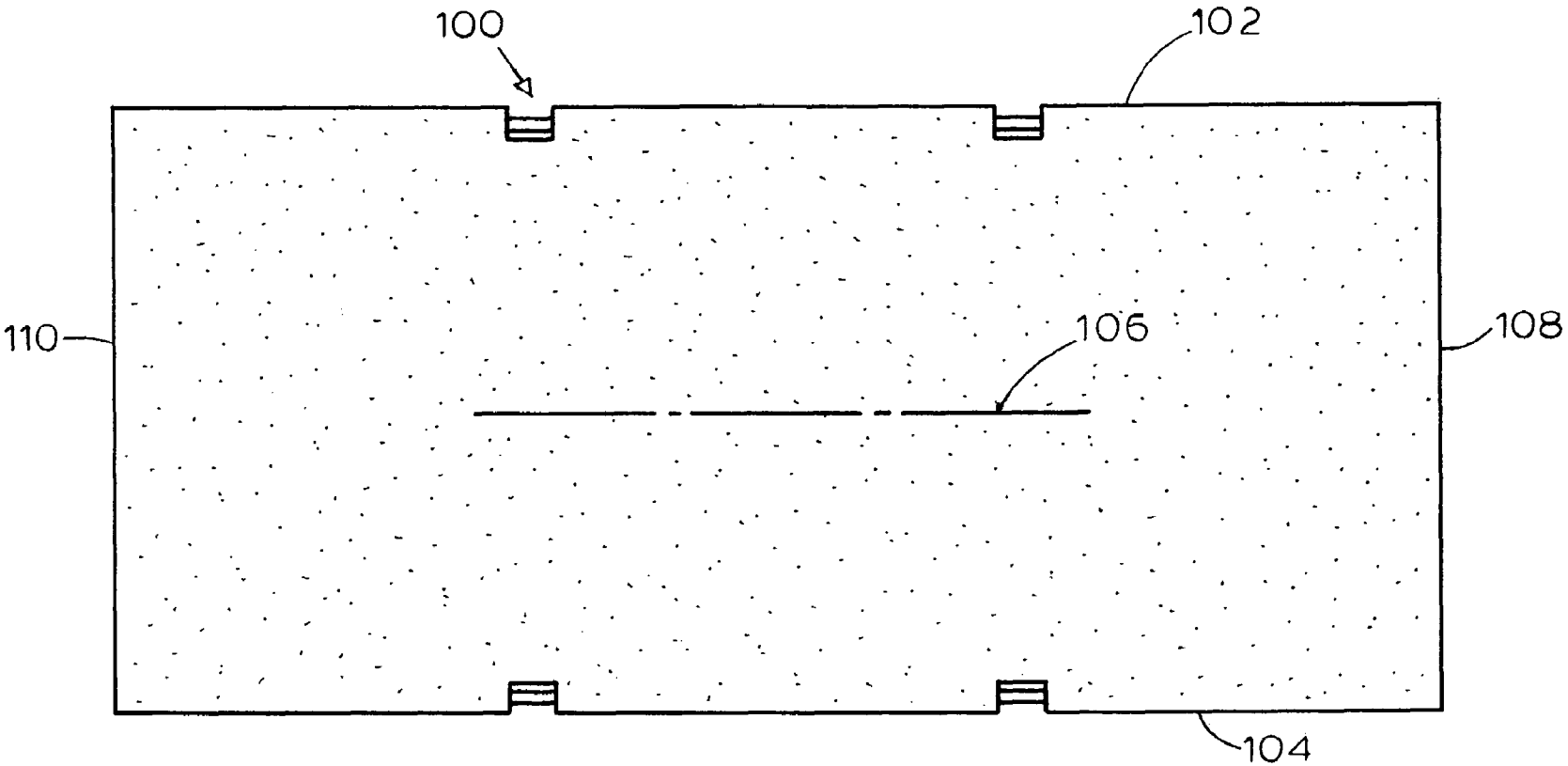
FIG. 4 is an element 10' which includes elements used to couple one mat to adjacent elements.
Figure 5:
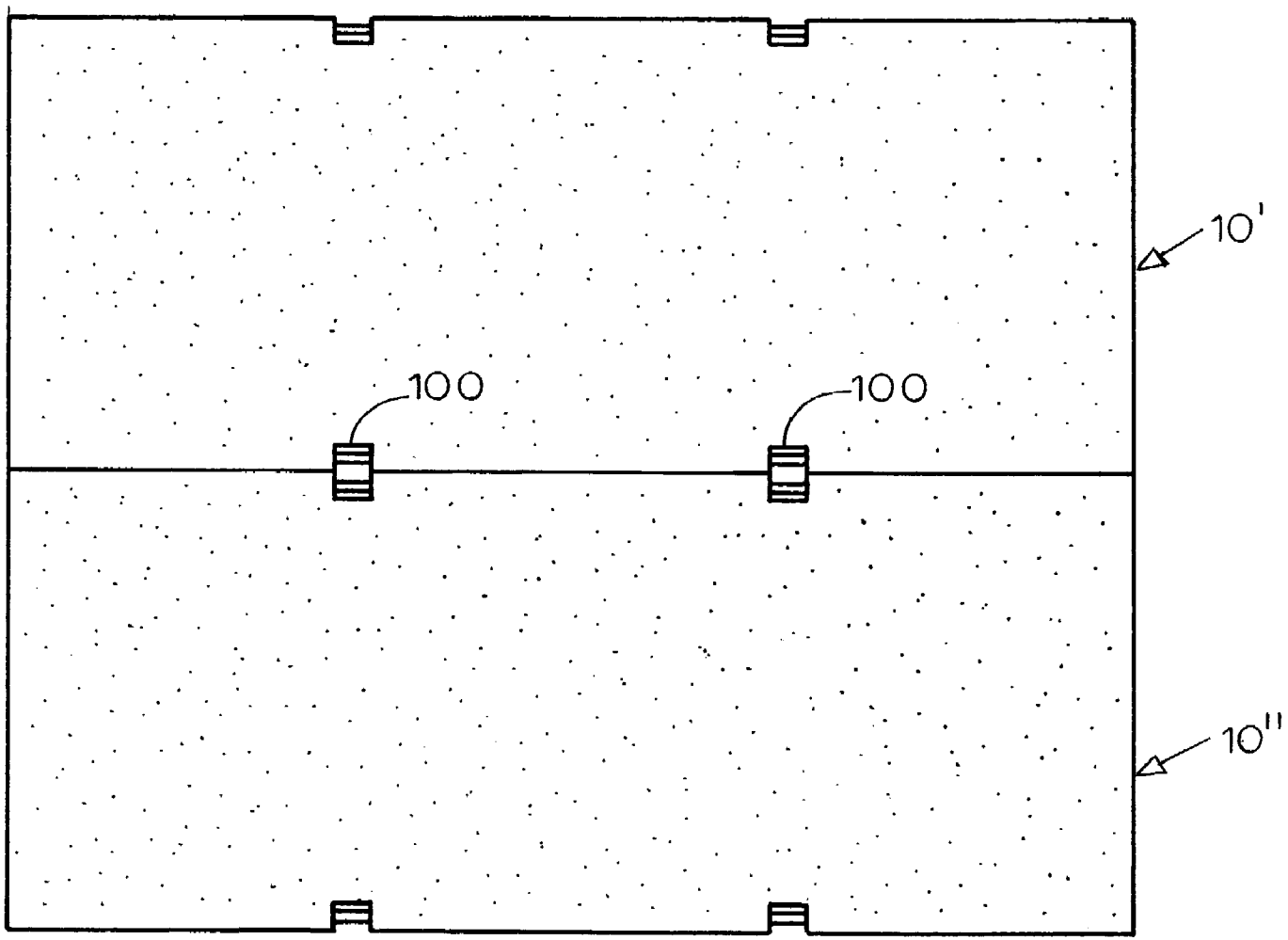
FIG. 5 shows two roadway elements coupled together.

A roadway element 10' is shown in FIG. 4 which includes the one-piece mat encasing the wood planks as above described. However, roadway element 10' includes coupling means 100 located on side edges 102 of the one-piece mat at locations that are spaced apart from each other in the direction of axis 106 which extends between end edges 108 and 110 of the mat of roadway element 10'. As shown in FIG. 5, two adjacent roadway elements 10' and 10" are coupled together by means 100.

Figure 6:
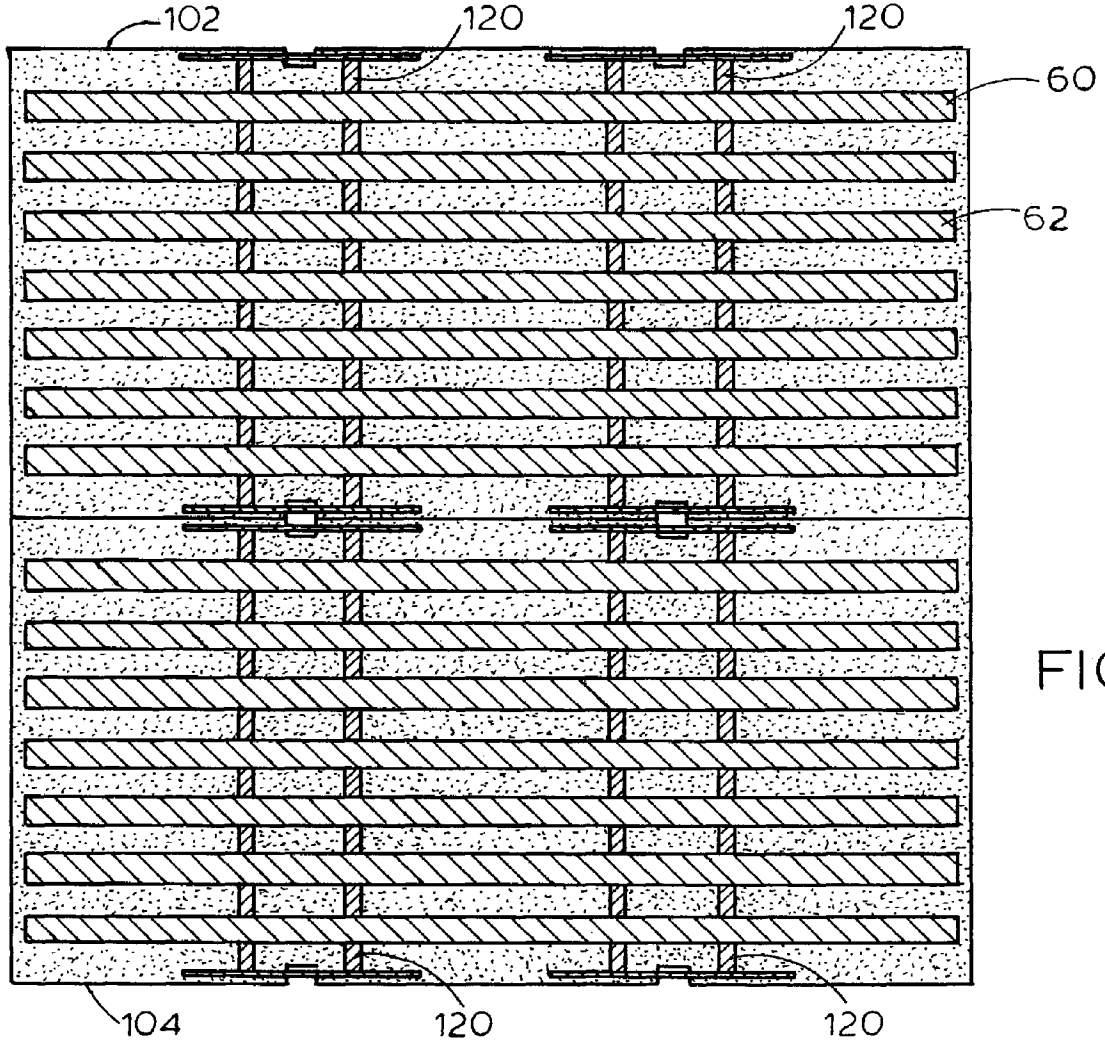
FIG. 6 shows two roadway elements coupled together with the internal structure of the elements being shown.
Figure 7A:
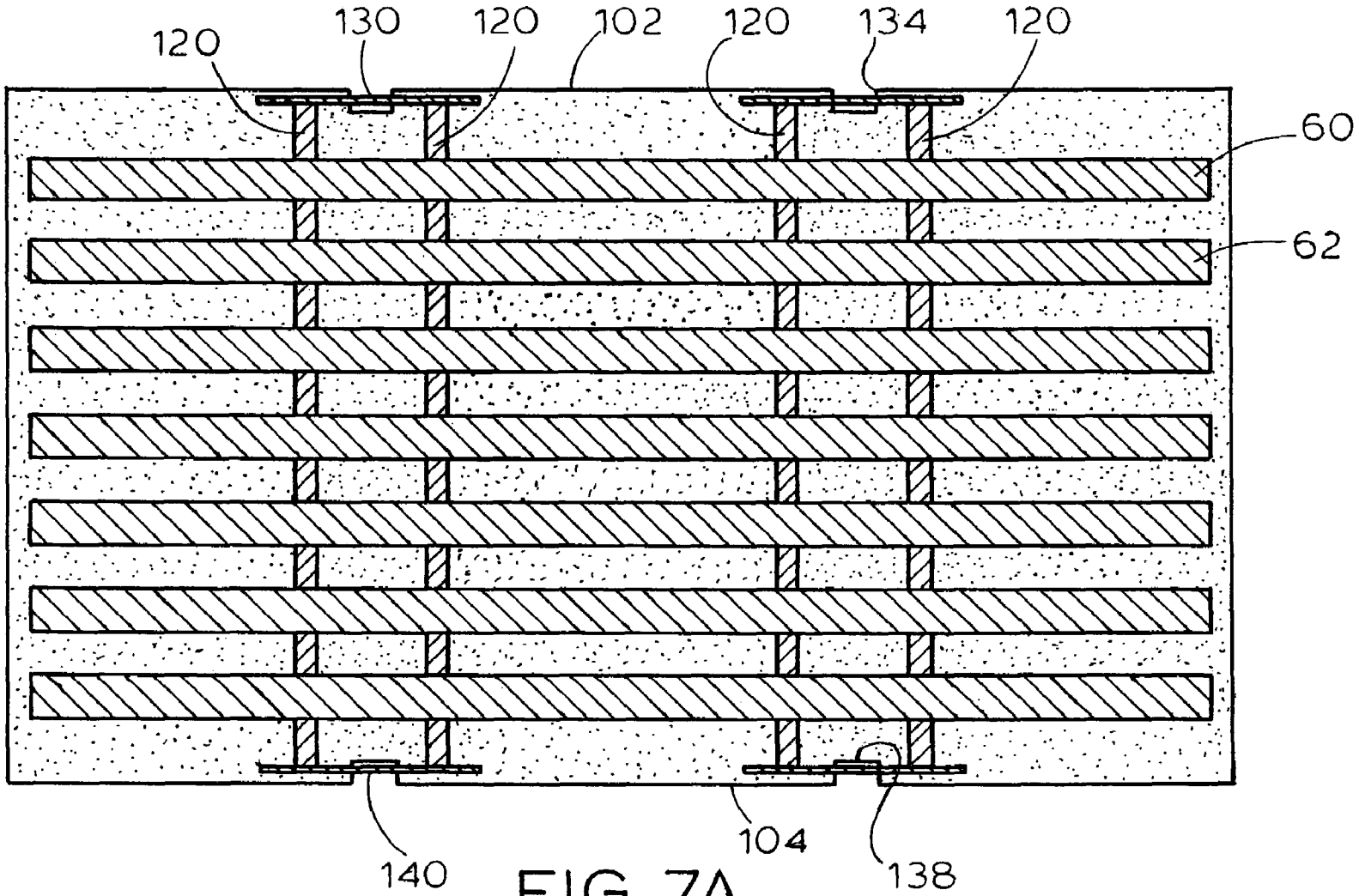
FIG. 7A shows a detailed view of a roadway element showing the internal structure thereof.
Figure 7B:
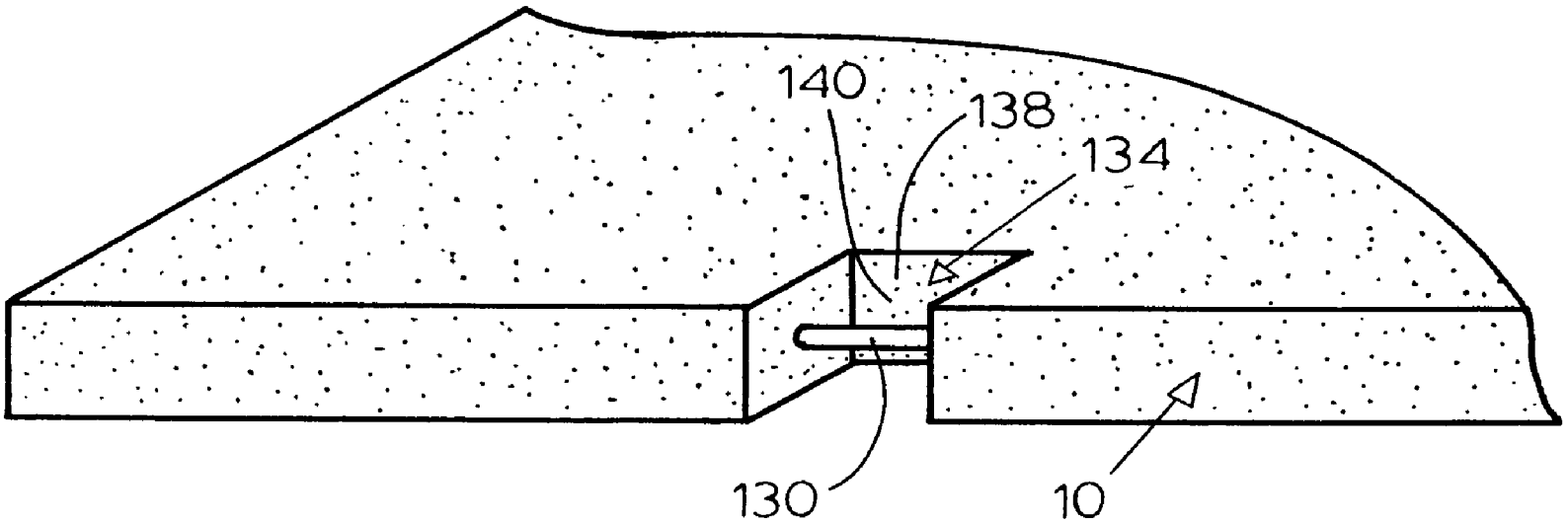
FIG. 7B shows detailed view of a cavity of a roadway element used to couple one roadway element to an adjacent roadway element.

Coupling means 100 is more clearly shown in FIGS. 6, 7 and 7A and include straps 120, such as nylon straps, extending through the roadway element between side edges 102 and 104 to connect steel bars 130 together. Straps 120 are also connected to the wood planks, such as planks 60 and 62. A cutout portion 134 is defined in the side edges between adjacent straps whereby the steel bars connect pairs of adjacent straps together and span the cutout portion located between the straps. As can be understood from the figures, the steel bars span the cutout portion and are spaced apart from a rear surface 138 of each cutout portion to define a gap 140 between the steel bar and the side edge of the mat adjacent to the steel bar. The steel bars extend in the direction of the side edges of the mat and the straps extend in the direction of the end edges of the mat.

Straps 120 as well as steel bars 130 are embedded in the rubber mat so the overall element, including the mat and the wood planks and the straps and the steel bars is a one-piece element. Thus, the straps and the steel bars are placed in the molten mixture in the mold along with the wood planks before the pressure is applied as discussed above regarding the process of forming element 10.

A coupling clamp element 150 is used to couple adjacent roadway elements 10' together. As can be understood from FIGS. 8A, 8B and 9, element 150 is accommodated in the cutout portions of the elements. When adjacent roadway elements are positioned to be coupled together, the cutout portions of the two adjacent elements are located with respect to each other to define a cavity 154 with the corresponding steel bars of both elements located in the cavity. Element 150 includes a U-shaped body 160 having two legs 162 and 164 connected together by a bight section 166. Each leg includes a first surface 170 that is located adjacent to a corresponding rear surface 138 and a second surface 172 that is oriented to be presented to the other leg of element 150. The legs of element 150 are located in gaps 140 defined between the steel bars and the rear surfaces 140 of the cavities. A hole 176 is defined through bight section 166 and a shaft 180 extends through hole 176 to be rotatably mounted on clamp element 150. Shaft 180 has a head 182 on one end thereof and a plate 184 on the other end thereof. Plate 184 is located in the cavity 154 when element 150 is in use. A second plate 188 is mounted on plate 184 and is connected to shaft 180 for rotation therewith. A spring 190 has one end 192 abutting inner surface 194 of bight section 166 and a second end 196 abutting plate 188. Spring 190 biases plate 188 away from inner surface 194 to maintain plate 188 in a desired position as will be understood from the teaching of this disclosure. Plate 188 is maintained in a position to locate steel bars 130 between plate 188 and inner surface 194 of bight section 166 as can be seen in FIGS. 8A, 8B and 9 when element 150 is in use.

A screw head 200 is fixed to shaft 180 and is rotatably mounted on outer surface 202 of bight section 166. Screw head 200 has a cutout portion 204 in which head 182 of shaft 180 is located. Shaft 180 is connected to head 200 for rotation therewith.

Figure 8B:
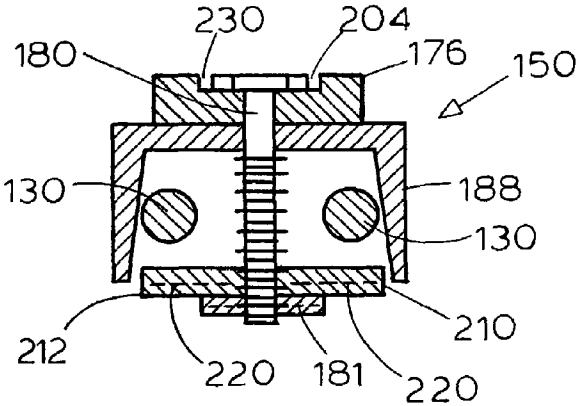
FIG. 8B shows the coupling element in a locking condition.
Figure 8A:
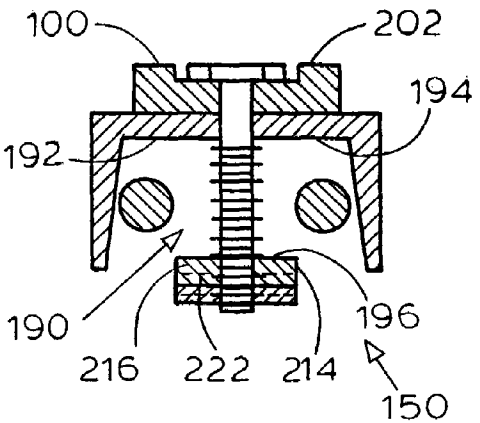
FIG. 8A shows a coupling element in an open condition.
Figure 9:
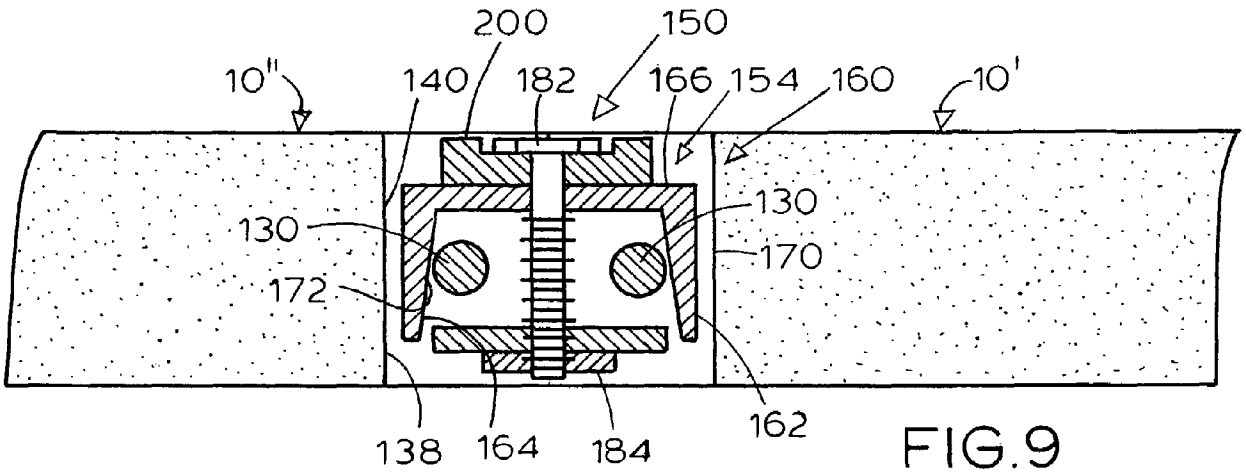
FIG. 9 shows a coupling element locking two adjacent roadway elements together.

Plate 188 is rectangular as can be understood from FIGS. 8A and 8B. Plate 188 has two end edges 210 and 212 and two side edges 214 and 216. Plate 188 is mounted on shaft 180 for rotation therewith. As can be understood from FIGS. 8A and 8B, when shaft 180 is rotated one-quarter turn, plate 188 rotates from an unlocking orientation shown in FIG. 8A with side edges 214 and 216 located parallel to and adjacent to the steel bars, to a locking orientation shown in FIG. 8B with end edges 210 and 212 located parallel to and adjacent to the steel bars. Plate 188 has a length dimension 220 which extends between end edges 210 and 212 and a width dimension 222 which extends between side edges 214 and 216. In the unlocking orientation of plate 188, width dimension 222 is smaller than spacing 230 between adjacent steel bars so plate 188 could move between the adjacent steel bars; whereas, when the plate is in the locking orientation, length dimension 220 is greater than spacing 230 between adjacent steel bars so that plate 188 will abuttingly engage the adjacent steel bars to lock the adjacent elements 10' and 10" together when the plate and element 150 are in the locking orientation shown in FIGS. 8B and 9.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A temporary roadway element comprising:

first and second one-piece rubber mats, each mat having a plurality of boards incorporated therein;

coupling means coupling the first mat to the second mat when the mats are in use and including bars embedded in each mat and straps embedded in each mat with the straps of the first mat connected to the bars of the second mat to couple the first and second mats together for use.

2. The temporary roadway element defined in claim 1 wherein the mat encases the boards.

3. The temporary roadway element defined in claim 2 wherein mat and the boards are a monolithic, one-piece element.

4. The temporary roadway element defined in claim 3 wherein the mat is formed of materials that include crumb rubber.

5. The temporary roadway element defined in claim 4 wherein discarded vehicle tires are the source of the rubber.

6. The temporary roadway element defined in claim 5 wherein the mat is formed of materials that include crumb rubber, fiber mix, and polyurethane binders.

7. The temporary roadway element defined in claim 6 wherein adjacent boards are spaced apart by at least four inches.

8. The temporary roadway element defined in claim 1 wherein the coupling means further includes a clamping element coupling bars of one mat to bars of an adjacent mat.

9. The temporary roadway element defined in claim 8 wherein the clamping element includes a rectangular plate which is rotatably mounted on the clamping element to move between a locking orientation engaging steel bars of the first-mentioned mat and steel bars of the second mat to couple the first-mentioned mat to the second mat and an unlocking orientation.

10. A roadway comprising:

first and second one-piece rubber mats, each mat having a plurality of boards incorporated therein;

coupling means coupling the first mat to the second mat and including bars embedded in each mat and straps embedded in each mat with the straps of the first mat connected to the bars of the second mat to couple the first and second mats together.

11. A temporary roadway element for use in association with heavy equipment formed by a process which comprises:

forming each of two molded slabs by providing crumb rubber from recycled tires, adding fiber mix to the crumb rubber, and binding the fiber mix and the rubber using polyurethane binders;

reinforcing each molded slab by setting wood planks in the slab, and encasing the wood planks in the molded slab;

forming a coupling means on each molded slab by embedding bars in each molded slab, and embedding straps in each molded slab; and forming a temporary roadway by coupling the straps of one molded slab to the bars of an adjacent molded element.

12. The temporary roadway element defined in claim 11, wherein the step of setting wood planks includes spacing adjacent wood planks at least four inches apart from each other.

13. The temporary roadway element defined in claim 12, wherein the wood planks are green mill run rough cuts wood planks sized to be three inches thick by twelve inches wide.

* * * * *